US006261366B1

(12) United States Patent
Dubs et al.

(10) Patent No.: US 6,261,366 B1
(45) Date of Patent: Jul. 17, 2001

(54) SUCTION DEVICE FOR A DOUBLE-POINT COATING SYSTEM

(75) Inventors: Max Dubs, Mulligen; Hubert Holdener, Stäfa, both of (CH)

(73) Assignee: Schaetti AG, Wallisellen (CH)

( * ) Notice: Subject to any disclaimer, the term of this patent is extended or adjusted under 35 U.S.C. 154(b) by 0 days.

(21) Appl. No.: 09/294,855

(22) Filed: Apr. 20, 1999

(30) Foreign Application Priority Data

Apr. 21, 1998 (CH) ..... 19980913/98
Aug. 11, 1998 (CH) ..... 19981657/98

(51) Int. Cl.[7] ..... B05C 19/06
(52) U.S. Cl. ..... 118/50; 118/308
(58) Field of Search ..... 118/50, 70, 308; 427/294, 198; 162/199, 274

(56) References Cited

U.S. PATENT DOCUMENTS 1,635,317 * 7/1927 Feeney ..... 162/274
3,013,938 * 12/1961 Justus et al. ..... 162/274
4,571,351 2/1986 Schaetti ..... 427/288
5,094,886 * 3/1992 Bogardy ..... 118/50
5,225,140 * 7/1993 Hayashikoshi et al. ..... 118/50
5,360,481 * 11/1994 Ludwig ..... 118/50
6,007,632 * 12/1999 Reis et al. ..... 118/50

* cited by examiner

*Primary Examiner*—Laura Edwards
(74) *Attorney, Agent, or Firm*—Weingarten, Schurgin, Gagnebin & Hayes LLP

(57) ABSTRACT

A suction device for a double-point coating system is used to remove excess powder (3') from a double-coated fabric web (1). The suction device has a powder-suction element (4) to remove excess powder, a fabric-web-suction unit to align the fabric web and at least one beater roller (8, 9) to loosen excess powder. The fabric web suction unit has at least one suction roller (5, 6, 7) that can rotate to convey the fabric web (1) and support it. That way, the fabric webs can be transported tension-free, which largely prevents adhesion of individual dots of paste and clogging of the textile.

15 Claims, 3 Drawing Sheets

SUCTION DEVICE FOR A DOUBLE-POINT COATING SYSTEM

FIELD AND BACKGROUND

The present invention concerns a suction device for a double-point coating system.

In double-point coating, first a paste is applied to a fabric web in dots at even intervals and a powder is then sprinkled over it, by means of which the paste points or bumps and the areas in between them are at least partially covered with the powder.

However, the goal of double-point coating is to produce fabric webs that have, at least on one top side, individual nops or dots made of a paste and a powder sprinkled on them connected to the paste, so that the fabric web stays uncoated in the areas between the individual nops or dots. Therefore, suction devices are used that suck loose powder off the fabric web.

A proven suction device is known in which a fabric web is run under a powder-suction element which sucks off the loose powder. Two suction nozzles are arranged in the direction in which the fabric web moves, before and after the powder-suction element, that suck down the fabric web from underneath and thus provide tension on the fabric web. A beater roller is arranged in the direction of movement in front of the powder-suction element, said beater roller making a beating motion on the bottom of the fabric web, thus throwing the powder up before it is caught by the powder-suction element and sucked off for further use or disposal.

Although this double-point suction device yields satisfactory results, the arrangement of the paste/powder points has nonetheless often been shown to be uneven and, in serious cases, the powder even clogs the fabric. This is especially true in the case of elastic materials. The reason for this is that the fabric webs in the double-point suction device are subjected to tension, which stretches the fabric.

The problem of the present invention is to create a double-point suction device in which the fabric web is subjected to no tension or subjected only to slight tension.

BRIEF SUMMARY

This problem is solved by a double-point suction device with the features exemplified herein below.

By using rotating, actively driven suction rollers instead of fixed suction nozzles, the fabric web may be moved through the double-point suction device without tension.

In one preferred embodiment, a suction roller is arranged under a powder-suction element having a suction channel. Preferably, this suction roller has at least one blow nozzle in order to stir up the powder or keep it suspended.

Advantageously, at least one other suction roller is arranged in front of the powder-suction element, in relation to the direction of movement of the fabric web. To prevent the suction roller from sticking, there is a squeegee or at least one blow nozzle to remove powder deposits on the suction roller. The advantage of the blow nozzle is that it may be arranged inside the suction rollers in order that the suction holes in the roller may be cleaned by being blown out.

DESCRIPTION OF THE DRAWINGS

An exemplary embodiment of the subject of the invention is presented on the attached figures and explained in the description below.

DETAILED DESCRIPTION OF THE INVENTION

Figure 1:
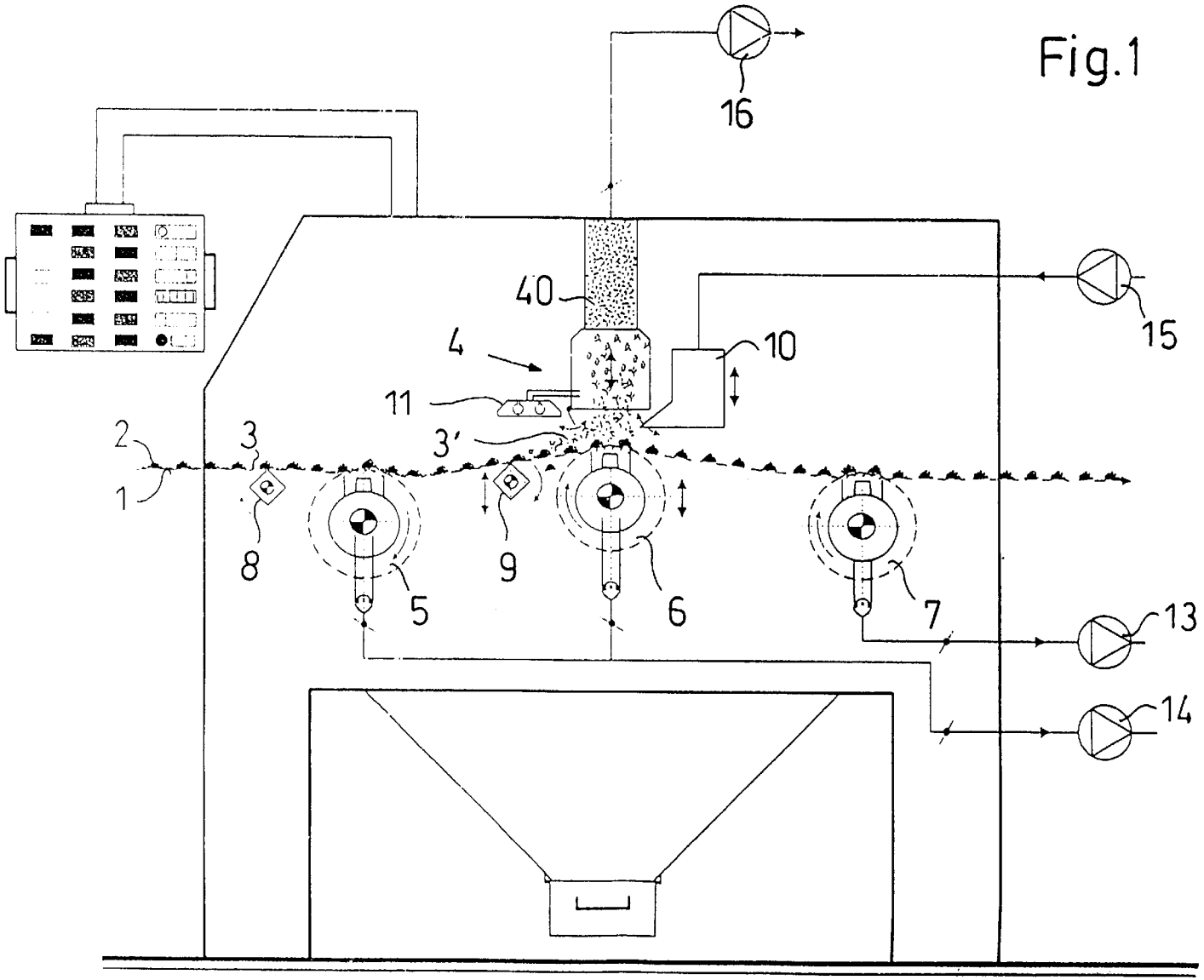
FIG. 1 shows a schematic view of a suction device according to the invention for a double-point coating system.

FIG. 1 shows a fabric web 1 which has been coated with dots by a coating system with a paste 2 and with powder 3 sprinkled over it, and is being conveyed through a double-point suction device according to the invention in order to remove the excess powder 3' not connected to the paste 2. The means used for this purpose are known and are therefore not shown or described here.

The double-point suction device according to the invention is designed as follows, wherein the individual elements are described in the direction of transport of the fabric web:

A control element 11, for example a UV lamp, is arranged above the coated top of the fabric web 1. Said control element 11 is followed by a powder-suction element 4 with a suction channel 40 and a set of controls 16, and then an air-seal nozzle 10 and associated a valve 15.

On the bottom of the fabric web and some distance in front of the powder-suction element, there is a first rotating beater roller 8 having a square cross section in this example. Said beater roller 8 is followed by a first suction roller 5 in the form of a perforated roller and a second beater roller 9, also having a square cross section. All known means that make a beating motion on the fabric web can be used for the beater rollers. Other shapes are possible for the cross section of the beater roller.

A second suction roller 6 is arranged under the powder-suction element 4 having a height that can be adjusted. Preferably, the suction roller 6 is arranged higher than the first suction roller 5, in order that the fabric web runs through without lifting. Next, that is after the powder-suction element, there is a third suction roller 7, which is preferably arranged approximately at the same height as the first suction roller 5 and at the same distance from the second suction roller 6.

Preferably, all of the suction rollers 5, 6, 7 are composed of perforated template rollers in whose hollow spaces there is a partial vacuum. However, other rotating rollers that achieve an even suction effect may also be used. The suction effect is governed by means of controls 13, 14.

Preferably, all suction rollers 5, 6, 7 have the same diameter, wherein at least the second suction roller 6 arranged under the powder-suction element 4 may have its height adjusted. Since the suction rollers 5, 6, 7 are mounted in order that they may rotate, they turn with the fabric web 1 and they move the fabric web on them forward. Preferably, the topmost point of the surface of each of the suction rollers 5, 6, 7 lifts over the main plane of dispersion of the fabric web 1, wherein the first and third suction rollers 5, 7, also referred to as conveyor rollers, only lift the fabric web 1 slightly, for example on the order of the coating thickness. However, the second suction roller 6, also referred to as the supporting roller, lifts the fabric web 1 in a sinus shape.

The fabric web 1 being sucked is first run over the first beater roller 8, which makes a beating motion on the bottom of the fabric web 1, thus loosening the powder. The fabric web 1 then runs over the first suction roller 6, wherein the fabric web 1 is preferably lifted slightly. The second beater roller 9 loosens the excess powder permanently from the fabric web 1 and whirls it upward. By means of the second suction roller 6, the fabric web 1 is lifted in the direction of the powder-suction element 4, which sucks the excess powder 3' off through the suction channel 40. The control element 11 enables verification of whether the powder 3' not attached has actually been whirled up. The air-seal nozzle 10, also controlled by a valve 15, forms a barrier due to the air streaming out that prevents the stirred up powder from being able to pass the powder-suction element 4 and from being deposited again on the fabric web 1. The fabric web 1, which has passed the powder-suction element 4, is now run over the third suction roller 7 and is run to the next station for further processing.

Figure 2B:
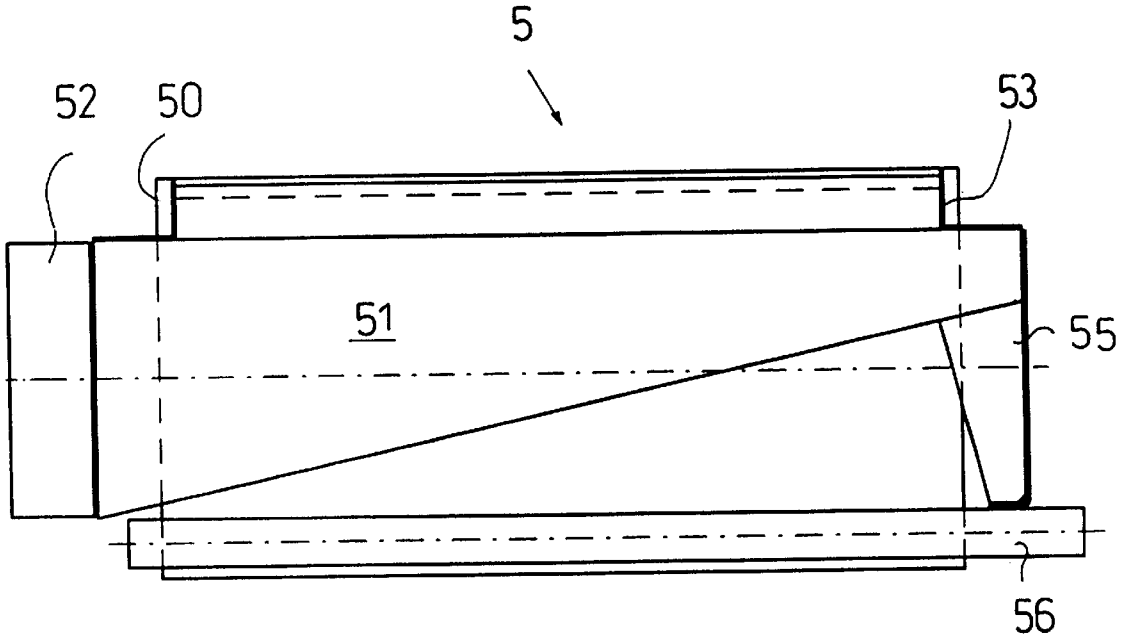
FIG. 2*b* shows a longitudinal section through the suction roller in FIG. 2*a;*
Figure 2A:
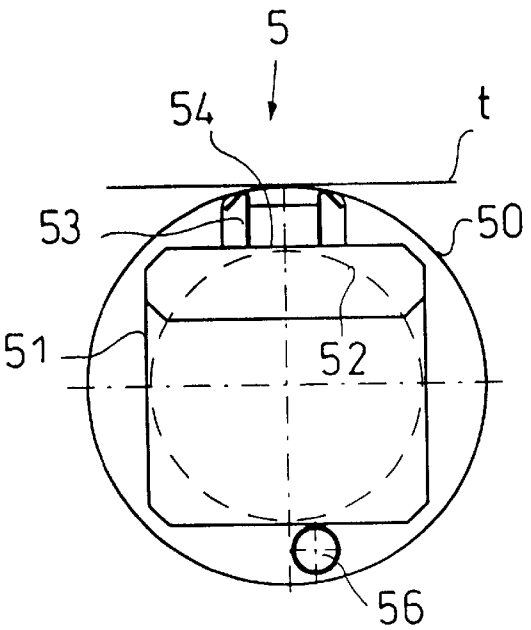
FIG. 2*a* shows a cross section through the first suction roller according to the invention.

FIGS. 2*a* and 2*b* show one special form of embodiment of a first suction roller 5 or conveyor roller, which is arranged in the direction of movement of the fabric web 1 in front of the powder-suction element 4. Said roller has a hollow roller tube 50 having suction holes distributed over its surface being preferably made of metal. The suction holes are preferably a fine screen of holes with a size of approximately 1000 $\mu$m and 11 mesh (holes per inch of length). The roller tube 50 is mounted on both ends by known means and may rotate around its central axis by means of drive means that are also known and are not shown here.

This roller tube 50 has a suction channel 51, preferably made of metal, that runs through it and is mounted in the roller tube 50. The suction channel 51 preferably projects on both sides out of the roller tube 50, and it is connected to an outer connecting tube 52, here shown with a round cross section, and is closed on its second end. The suction channel 51 preferably has a square cross section, wherein one side surface runs at least approximately parallel to the plane of the fabric web 1, and its diagonal in the area near the first end corresponds almost approximately to the diameter of the roller tube 50. The suction channel 51 becomes narrower toward the second end, wherein the top side facing the fabric web 1 runs at least approximately horizontal, and its width remains basically unchanged as well. On its second end, a supporting element 55 projecting downward is arranged, which is used to support the suction channel 51 on another blow tube 56 described below or another fixed element. The suction channel 51 is thus held in its position on one hand by the connecting tube 52 and on the other by the supporting element 55, wherein the roller tube 50 may rotate around the suction channel 51 whose position is stable.

In another embodiment, not shown here, instead of the supporting element 55 there is a rounded slot, which is arranged on the bottom of the suction channel 51 and which interlocks, but slides on the inside of the roller tube 50.

The top of the suction channel 51 pointing toward the fabric web 1 has a suction hole 54, which extends at least approximately over the entire length of the roller tube 50 and which runs at least approximately parallel to the tangent t of the highest point of the roller tube 50. Either the suction channel 51 is designed to be slotted for this purpose, has a recess or the top has a screen having holes in it. This suction hole is surrounded on both sides along its entire length by labyrinth-like plates 53, which are arranged on top of the suction channel 51 and make contact with the inside of the roller tube 50 and loop over this inside with springs. Preferably these plates 53 are made of metal. In the suction space 54 formed by the plates 53, a partial vacuum is produced. A fabric web 1, which is moved over the suction rollers 5, is sucked over the screen of the roller tube 1, wherein the rotational movement of the suction roller 5 moves the fabric web 1 forward without tension.

A blow tube 56 is also arranged inside the roller tube 50 and has a stable position. It is in the direction of rotation of the suction roller 5 after the suction space 54. In this example, it is arranged under the suction channel 51. This blow tube 56 is connected to a connecting tube 57 on the first end and closed on the second end. It is mounted with known means which are arranged inside and/or outside the roller tube 50. The blow tube 56 has blow holes at least approximately over its entire length, facing the roller tube 50. Air streaming out is blown by the screen of the roller tube 50 and therefore removes any powder that may be stuck to the roller. The blow tube 56 thus acts as a means of cleaning. Instead of the blow tube 56, other cleaning means may be used, for example a squeegee that works on the outside of the roller tube 50.

The third suction roller 7 or conveyor roller which follows the powder-suction element 4, is in one preferred embodiment basically identical to the first suction roller 5 described above. However, it has no blow nozzles, since it does not become covered much with loose powder.

Figure 3B:
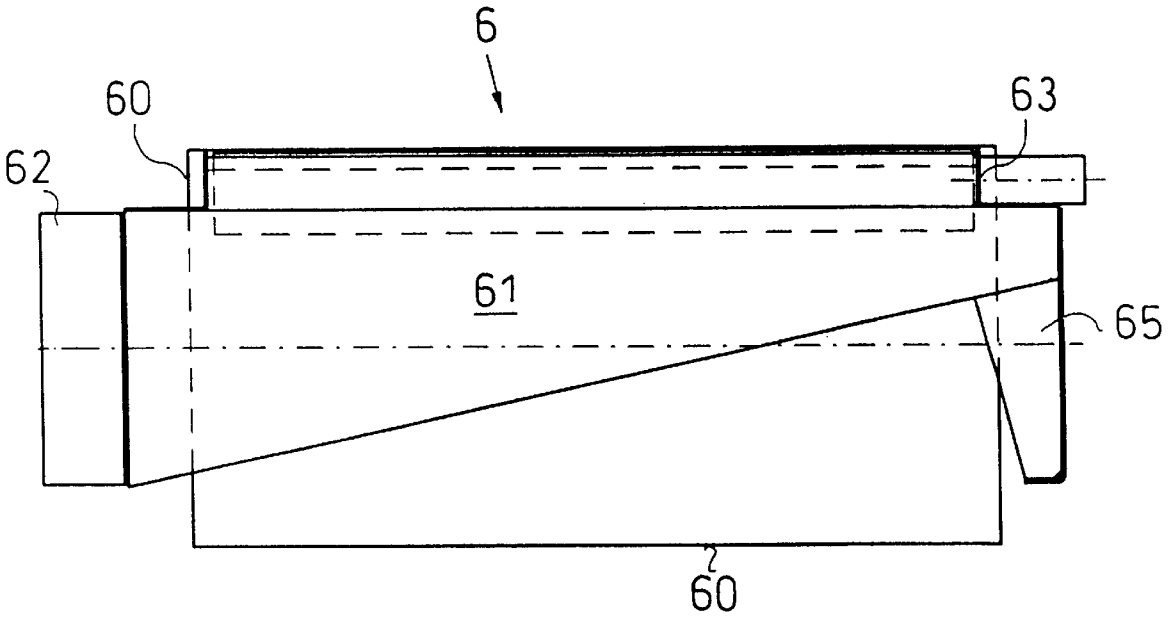
FIG. 3*b* shows a longitudinal section through the suction roller in FIG. 3*a.*
Figure 3A:
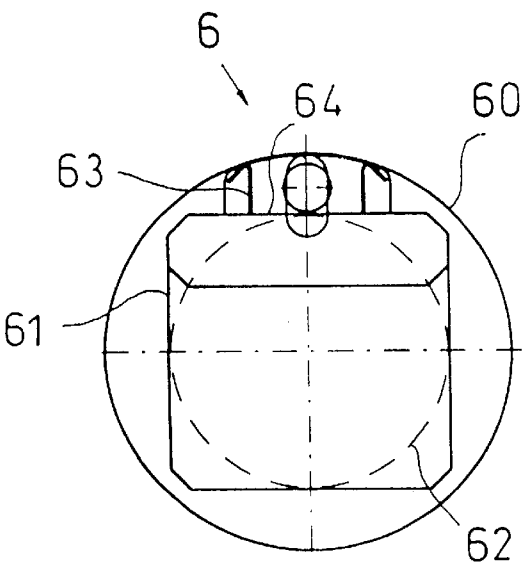
FIG. 3*a* shows a cross section through a second suction roller according to the invention.

FIGS. 3*a* and 3*b* show a second suction roller 6 or supporting roller. It is also basically identical to the second suction roller 5 described above. The roller tube in FIGS. 3*a* and 3*b* is marked with the reference number 60, the suction channel 61, the accompanying connecting pipe 62, the plates 63, the suction hole 64 and the supporting element 65. There is also in turn a blow element in the form of a blow tube 66, which is now used not to clean, but to loosen excess powder 3'. It is therefore not connected to the suction space but is arranged in front of it or, as shown here, preferably in it. In the example shown here, the blow tube 66 has an oval cross section, and its connecting pipe 57 has a round cross-section. These cross section shapes are not essential, however. The blow tube 66 in turn has blow holes, which point toward the roller tube 60. In the case of the second suction roller 7, the blow holes or nozzles preferably point perpendicularly upward or toward the powder-suction element. Air is blown through the blow holes and the screen of the roller tube 50 through the fabric web 1. In this way, excess powder that is not attached is kept suspended longer and powder still lying on the fabric web 1 is whirled up high. Loose excess powder 3' can thus be grasped better by the powder-suction element 4 and sucked off the fabric web 1. If the supporting roller 6 is raised, so that the fabric web is lifted as it passes over that roller, the intermediate spaces between the individual paste bumps are opened and the powder blown from the back loosens more easily.

The supporting and conveyor rollers described above may be used individually. However, to optimize the efficiency of the suction device, they are used in combination.

What is claimed is:

1. A suction device for a double-point coating system to remove excess powder from a double-coated fabric web, wherein the suction device comprises a powder-suction element to remove the excess powder, a fabric-web-suction unit to carry the fabric web and at least one beater roller to loosen the excess powder, wherein the fabric-web-suction unit has at least one suction roller that can rotate to convey the fabric web by supporting it, said suction roller being arranged under the powder-suction element.

2. The suction device in claim 1, wherein said suction roller is a perforated roller.

3. The suction device in claim 1, having at least three suction rollers, wherein a first suction roller is arranged in the direction of movement of the fabric web in front of the powder-suction element, a second suction roller under the powder-suction element and a third suction element after the powder-suction element.

4. The suction device in claim 3, wherein means of cleaning are arranged in at least one suction roller to clean the suction roller, wherein the means of cleaning includes a blow tube that is arranged inside the suction roller.

5. The suction device in claim 3, wherein at least one of said suction rollers is adjustable in height.

6. The suction device in claim 1, said suction roller being adjustable in height.

7. The suction device in claim 1, wherein means of cleaning are arranged in at least one suction roller to clean the suction roller, wherein the means of cleaning are arranged in the direction of rotation of the suction roller after the supporting point of the fabric web.

8. The suction device in claim 7, wherein the means of cleaning includes a blow tube that is arranged inside the suction roller and said at least one suction roller is arranged in the direction of movement of the fabric web in front of the powder-suction element.

9. A suction device for a double-point coating system to remove excess powder from a double-coated fabric web, wherein the suction device comprises a powder-suction element to remove the excess powder, a fabric-web-suction unit to carry the fabric web, and at least one beater roller to loosen the excess powder, wherein the fabric-web-suction unit has at least one suction roller that can rotate to convey the fabric web by supporting it, in which the suction roller has a roller tube that is mounted so it can rotate, the roller tube having suction holes and a suction channel going through it that is fixed in position and produces a partial vacuum in a suction space inside the roller tube.

10. The suction device in claim 9, wherein the suction space comprises the suction channel and plates, wherein the plates make contact with the inside of the roller tube.

11. A suction device for a double-point coating system to remove excess powder from a double-coated fabric web, wherein the suction device comprises a powder-suction element to remove the excess powder, a fabric-web-suction unit to carry the fabric web and at least one beater roller to loosen the excess powder, wherein the fabric-web-suction unit has at least one suction roller that can rotate to convey the fabric web by supporting it, wherein a blow element is arranged in said at least one suction roller to stir up excess powder.

12. The suction device in claim 11, wherein said at least one suction roller is arranged under the powder-suction element.

13. The suction device in claim 11, wherein said suction roller is arranged under the powder-suction element.

14. The suction device in claim 11, wherein the at least one suction roller has a roller tube that is mounted so it can rotate, the roller tube having suction holes and a suction channel going through it that is fixed in position and produces a partial vacuum in a suction space inside the roller tube.

15. The suction device in claim 11, wherein means of cleaning are arranged in at least one suction roller to clean the suction roller, wherein the means of cleaning includes a blow tube that is arranged inside the suction roller and said at least one suction roller is arranged in the direction of movement of the fabric web in front of the powder-suction element.

* * * * *

UNITED STATES PATENT AND TRADEMARK OFFICE

CERTIFICATE OF CORRECTION

PATENT NO. : 6,261,366 B1
DATED : July 17, 2001
INVENTOR(S) : Max Dubs et al.

It is certified that error appears in the above-identified patent and that said Letters Patent is hereby corrected as shown below:

Column 2,
Line 30, “a valve 15” should read -- valve 15 --.

Signed and Sealed this

Twenty-second Day of April, 2003

JAMES E. ROGAN
*Director of the United States Patent and Trademark Office*